United States Patent [19]

Silverman

[11] 4,227,696

[45] Oct. 14, 1980

[54] BOARD GAME

[76] Inventor: Irving Silverman, 454 Riverside Dr., New York, N.Y. 10027

[21] Appl. No.: 957,699

[22] Filed: Nov. 6, 1978

[51] Int. Cl.[3] ..... A63F 3/02

[52] U.S. Cl. ..... 273/260; 273/288

[58] Field of Search ..... 273/253, 262, 260, 261, 273/242, 236

[56] References Cited

U.S. PATENT DOCUMENTS

| | | | |
|---|---|---|---|
| 1,534,245 | 4/1925 | Pitton | 273/242 |
| 1,617,250 | 2/1927 | Haughton | 273/242 |
| 2,703,713 | 3/1955 | Moyer | 273/262 |
| 3,048,404 | 8/1962 | Tebbs | 273/262 |
| 3,565,438 | 2/1971 | Bischof | 273/253 |
| 3,877,703 | 4/1975 | Pierre | 273/240 |
| 3,938,808 | 2/1976 | Bockman | 273/242 |

FOREIGN PATENT DOCUMENTS

| | | | |
|---|---|---|---|
| 2654115 | 6/1977 | Fed. Rep. of Germany | 273/260 |
| 698755 | 2/1931 | France | 273/261 |

*Primary Examiner*—Richard C. Pinkham

*Assistant Examiner*—Carl Moy

*Attorney, Agent, or Firm*—Burns, Doane, Swecker & Mathis

[57] ABSTRACT

A board game comprises a board containing a plurality of playing areas which contiguously form diagonal rows. A plurality of sets of pieces are positioned on the playing areas and are movable thereon. Each piece includes an indicator which, when oriented in the direction of one of the rows toward a piece of the other set, places the latter piece under attack. Each piece originally is oriented on its associated playing area out of the direction of the rows so as to be unable to place a piece of the other set under attack. Each playing area has a smaller attack area therein oriented at an angle relative to the playing area and corresponding in shape to the pieces. Accordingly, when a piece is turned to an attack position, it is aligned with the attack area. The sets of pieces are initially set up on the playing areas to form mutually facing pyramids with the front piece of one pyramid laterally offset relative to the front piece of the other pyramid.

11 Claims, 2 Drawing Figures

BOARD GAME

BACKGROUND AND OBJECTS OF THE INVENTION

The present invention relates to games of amusement and, in particular, to board games of the type which can be played by two or more people, including a board with a series of playing squares and pieces which can be moved about on the squares.

There have been heretofore proposed numerous types of board games in which pieces are moved about squares on the board. Games such as "checkers" have simplistic rules and identical pieces and thus are easy to learn and relatively inexpensive to manufacture. However, games such as checkers do not involve as high a level of skill and strategy as many people desire.

Board games such as chess offer higher levels of skill and strategy, but have numerous different pieces with different rules of movement for each, and are thus more expensive to manufacture and more difficult to learn. It is, therefore, an object of the invention to provide a novel board game.

It is another object of the invention to provide a novel board game which utilizes inexpensive components and simplified rules and which involves a high level of skill and strategy.

It is a further object of the invention to provide a novel board game which comprises only a simplistic board and two sets of identically formed pieces and which involves a complex level of skill and strategy.

BRIEF SUMMARY OF A PREFERRED EMBODIMENT OF THE INVENTION

These objects are achieved by the present invention which involves a board game comprising a board containing a plurality of playing areas which form diagonal rows. A plurality of sets of pieces are positioned on the playing areas and are movable thereon. Each piece includes an indicator which, when oriented in the direction of one of the rows toward a piece of the other set, places the latter piece under attack. Each piece is originally oriented on its associated playing area out of the direction of the rows so as to be unable to place a piece of the other set under attack.

Preferably, each playing area has a smaller attack area therein oriented at an angle relative to the playing area and corresponding in shape to the pieces. Accordingly, when a piece is turned to an attack position, it is aligned with the attack area.

Preferably, the sets of pieces are initially set up on the playing areas to form mutually facing pyramids with the front piece of one pyramid laterally offset relative to the front piece of the other pyramid.

THE DRAWING

These and other objects and advantages of the invention will become apparent from the following detailed description of a preferred embodiment thereof in connection with the accompanying drawings in which like numerals designate like elements, and in which.

DETAILED DESCRIPTION OF A PREFERRED EMBODIMENT OF THE INVENTION

A board game according to the present invention comprises a board 10 formed of any suitable material, such as cardboard for example. Preferably, the board can be folded in half about a scored centerline 12.

The playing surface of the board is divided into a plurality of separate areas or boxes, preferably in the shape of squares 14. Only alternate ones 14A of the squares may be occupied by player pieces; the remaining squares 14B serve simply to separate the playing squares 14A. The playing squares 14A and the separating squares 14B may be of diverse appearance, e.g., two different colors or patterns, so as to be easily distinguishable from one another.

Preferably, the board 10 is identical with a conventional checkerboard or chessboard in that it comprises eight rows of squares along either side, with four playing squares 14A located in each row. The playing squares 14A are located immediately adjacent one another in diagonal rows. The board is primarily intended for use with two sets of pieces, each set containing ten pieces, although the use of other board patterns and quantities of pieces is possible within the scope of the invention.

The playing squares 14A each include an internal "attack" area of square 16 inscribed within the boundary of the playing square, which attack square 16 is smaller than the playing square and is diagonally offset relative thereto by 45 degrees. The attack square 16 is preferably of a different color or pattern relative to the remainder of the associated playing square 14A and also relative to the separating squares 14B, to be readily distinguishable therefrom.

The board game further comprises two sets of pieces 18A, 18B. The pieces 18A are preferably mutually identical and the pieces 18B are preferably mutually identical. The pieces 18A are of a diverse appearance relative to the pieces 18B, as will be discussed, so as to be readily distinguishable therefrom.

Figure 4:
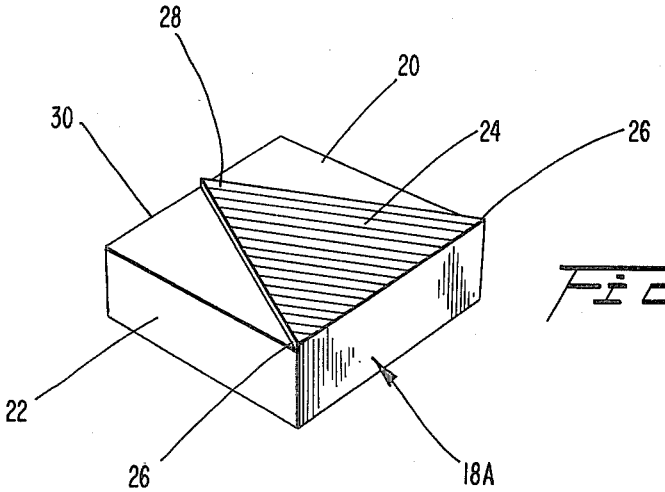
FIG. 4 is a perspective view of a playing piece according to the present invention.

Each piece 18A, 18B preferably comprises a block having top and bottom surfaces 20 (only the top surface is illustrated in FIG. 4) and four side surfaces 22 (only two side surfaces are illustrated in FIG. 4). The top and bottom surfaces 20 are preferably square in shape and slightly smaller than the attack squares 16.

Each piece 18A, 18B contains an indicator or pointer of some nature. In the preferred embodiment a triangular pointer portion 24 is provided such that two corners 26 of the triangle coincide with two corners of the top surface 20, and the third corner 28 of the triangle bisects an edge 30 of the top surface. Thus, the corner 28 constitutes the indicator or pointer portion of the piece.

The indicator of one set of pieces 18A may be of a different color (e.g., red) than that of the other set 18B (e.g., green), so as to distinguish the pieces of one player from those of the other player.

It will be appreciated that other forms of pieces could be used, so long as the different sets are mutually distinguishable and each piece includes an indicator.

Figure 1:
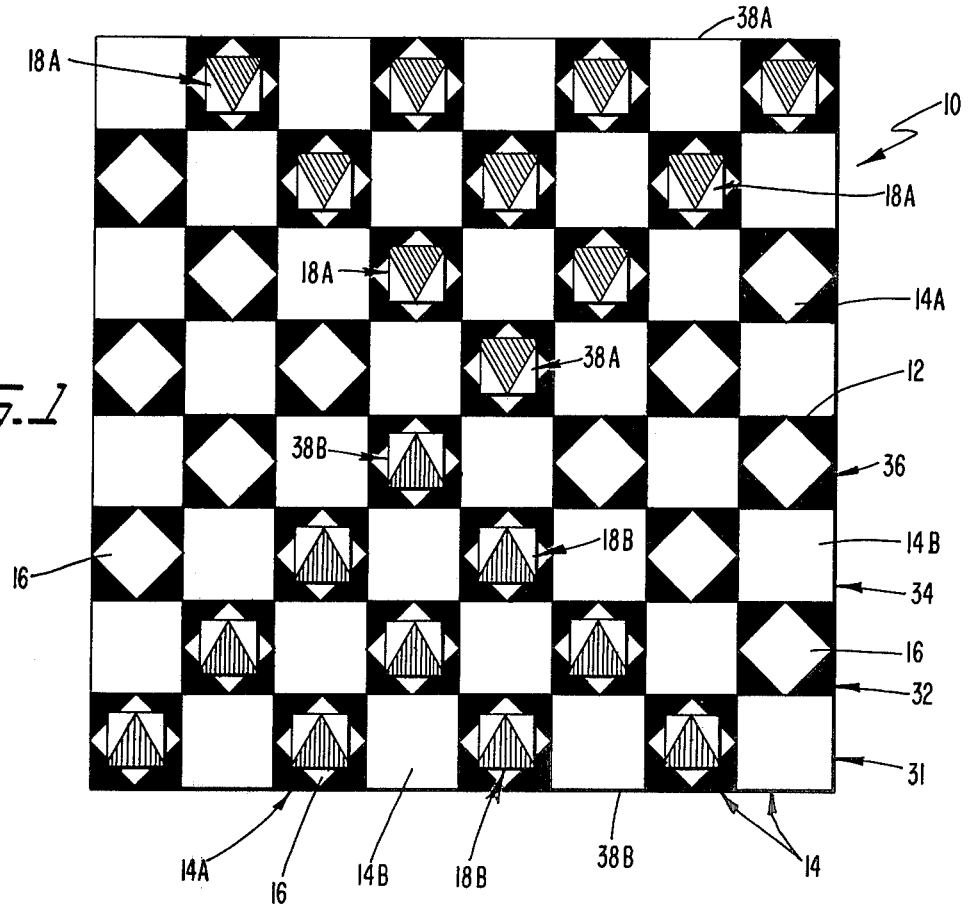
FIG. 1 is a plan view of a board game according to the present invention depicting the manner in which the pieces are initially set up.

The game is played by two players, designated hereafter as the A party and B party. Initially, each set of pieces is arranged to form a pyramid (FIG. 1). That is, if ten pieces are utilized on each side, then each side occupies four rows on the board, there being four pieces in the back row 31, three pieces in the next row 32, two pieces in the succeeding row 34, and one piece in the front row 36. The sets of pieces are laterally offset on the board in that the front piece 38A on one side is laterally offset relative to the front piece 38B of the other side, rather than being in directly facing relation thereto. Thus, each of the pieces 14A, 14B are initially situated on a playing square and point toward the opposing back edge 38A or 38B of the opposite side of the board. After any piece has been moved from its initial position, it may not point straignt forward (or straight backward) but must thereafter point diagonally.

The pieces can only travel diagonally, i.e., along the playing squares 14A. A piece can be moved any (nonzero) number of playing squares at one time but may not "jump" another piece in its path. Thus, to constitue a "move," a piece must "transfer" at least one square (at most seven squares) along an "open" diagonal.

Figure 2:
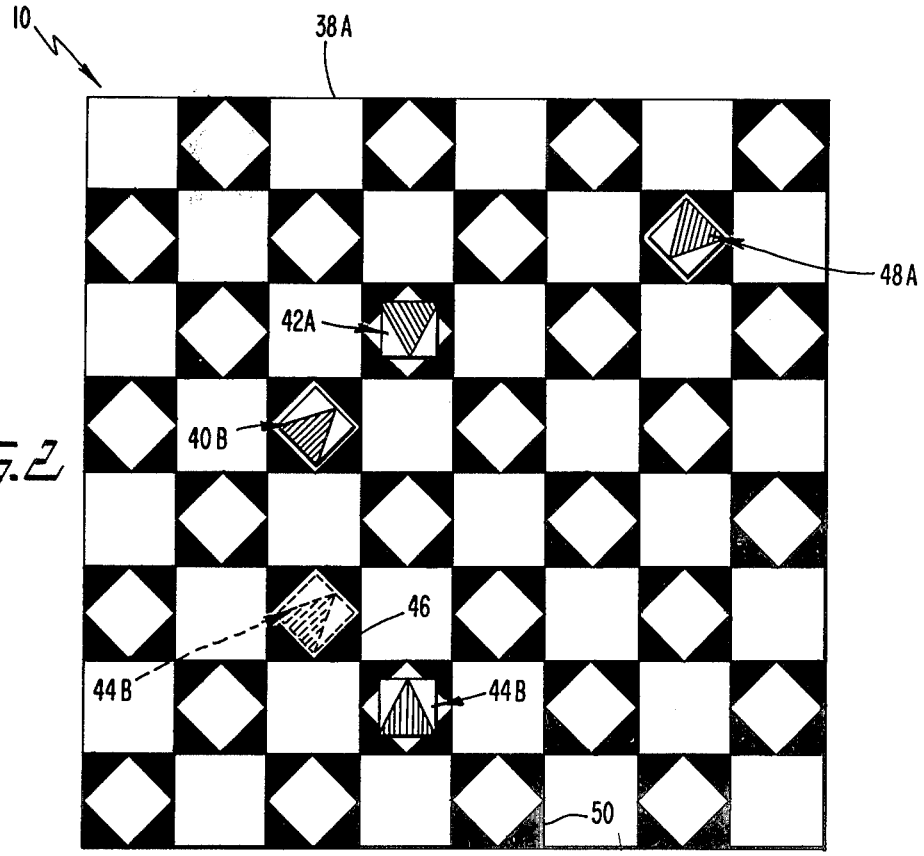
FIG. 2 is a plan view of the board game depicting various possible arrangements of pieces during play.

At the end of a move, the piece can be turned so as to point diagonally in any direction, as has the piece 40B in FIG. 2. When pointed diagonally, the piece 40B is aligned with the attack square of its associated playing square. If the indicator of piece 40B points to an opposing piece (e.g., 42A), with no other pieces interposed therebetween, then the opposing piece 42A is considered to be "under attack" by the piece 40B. If two opposite pieces are pointed at one another, then both pieces are considered to be under attack. Thus, a move of one piece may result in none, one, or two pieces being under attack. That is, if the piece 44B is moved to playing square 46 and turned forward right, toward the opposing piece 48A as depicted in phantom lines in FIG. 2, then both pieces 44B and 48A are under attack. If, however, the piece 44B is moved to playing square 46 but is oriented to face forward-left instead of forward-right, then only piece 44B is under attack (by piece 48A). If piece 44B is moved to square 50, then neither of the pieces 48A, 44B is under attack. In the position shown in solid lines in FIG. 2 neither of the pieces 44B, 48A is under attack. (Although the piece 44B is pointed at piece 42A, the former is not pointed in a diagonal direction and thus cannot place an opposing piece under attack.)

A piece is "vulnerable" when it is under attack by more than one opposing piece. The attacking party has a "right to capture" a vulnerable piece. When one party has captured all but one of the opposing party's pieces, the former thereby wins the game.

In the conduct of the game, the A and B parties take "turns" in which one side is the "mover" and the other side is the "stander." A turn consists of a "transfer" stage in which the mover alone takes action and a "disposition" stage in which either side may or may not take action, depending on the condition of the board.

In the transfer stage, the mover must change the location (along an open diagonal) of one and only one mover's piece leaving it pointed along any diagonal. When the transfer stage of a turn is completed, either the mover or the stander or both may have vulnerable pieces on the board, calling for an orderly disposition of rights.

In the disposition stage, stander's rights have priority over mover's rights. First the stander disposes of any apparent rights, then the mover disposes of any apparent rights, and then the play moves on to the transfer stage of the next turn.

The "disposition" of a right to capture is done in either of two ways. The right may be "exercised" by removing the vulnerable opponent's piece from the board, or the right may be "waived" by leaving the vulnerable piece in place. A right that is waived in one turn may be exercised at the appropriate time in a later turn, if the piece remains vulnerable. A player may have more than one right to capture at the same time and may dispose of such rights in any order. A player may have successive rights to capture if the completion of one capture makes another of the opponent's pieces vulnerable.

Figure 3:
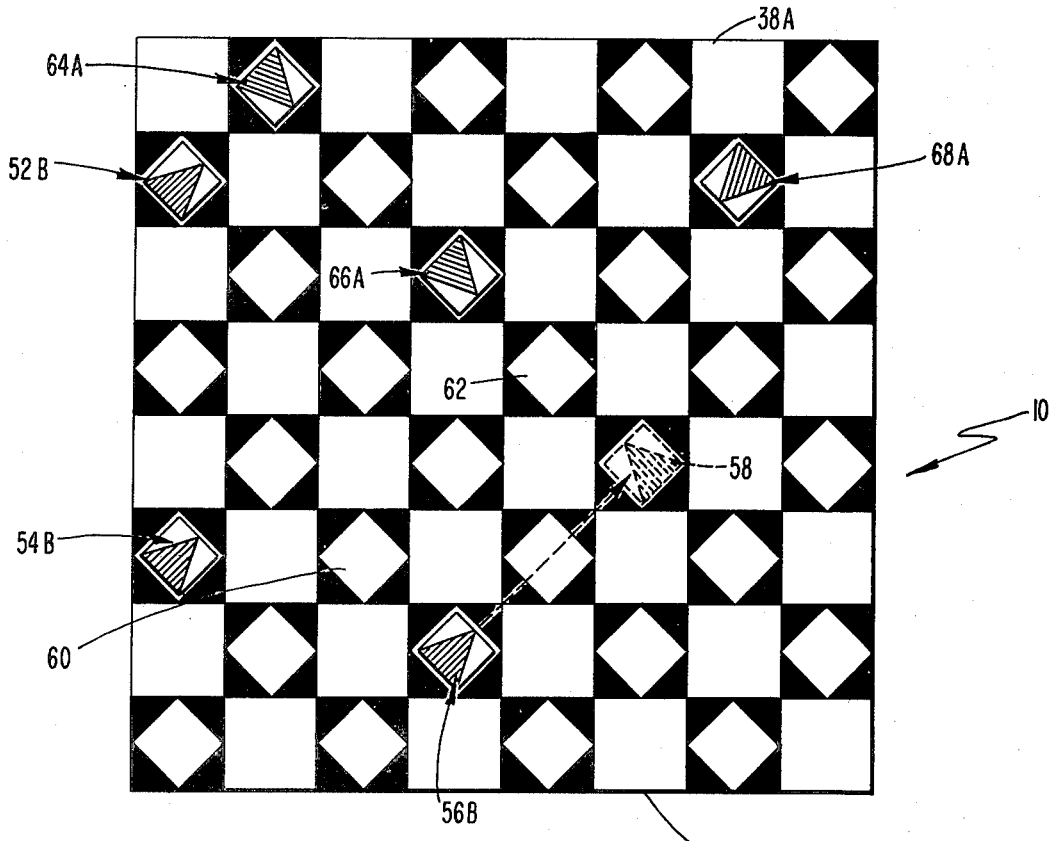
FIG. 3 is a view similar to FIG. 2 depicting other possible arrangements of pieces during play.

In FIG. 2, none of the pieces is under attack by more than one opposing piece, so no rights to capture exist. In FIG. 3, however, assuming that the B party has just moved the piece 56B to playing square 58, as depicted in phantom lines, then the piece 66A is under double attack, by 54B and 56B. In the disposition stage following that move, the A party (the stander party) presently has no rights to capture, so the B party (the mover party) has the right to capture the vulnerable piece 66A. Whereas in other situations a party may waive a right to capture for some tactical reason (such as keeping the opponent on the defensive), in this situation it is clearly of advantage for the B party to exercise the right to capture by removing piece 66A from the board. In so doing, the B party attains the right to capture piece 64A, which has been under attack by 52B and now additionally comes under attack by 56B upon the removal of piece 66A. By exercising two successive rights to capture, the B party leaves the A party with only one piece (68A) on the board, and thus the B party wins the game.

Alternatively, if the piece 56B had been located in playing square 60, and the B party had attempted to end the game by moving that piece to playing square 62, the attempt would have failed. In square 62, the piece 56B would have been vulnerable by reason of a double attack from pieces 66A and 68A. The A party as stander would have the prior right to capture following the B party's move. By exercising that right, thereby removing the piece 56B from playing square 62, the A party would leave the B party with no rights to capture in that turn, and with only two pieces against the A party's three. The A party would move next and could expect, with reasonable dilligence, to force a win by virtue of a one piece advantage in the end game.

It will be appreciated that the board game of the present invention is simplistic in equipment and rules, and yet there is a high level of skill and strategy involved during play. That is, each piece must be considered from the standpoint of its ability to move among squares as well as its ability to point in various directions to attack pieces which are located remotely thereof.

Although the invention has been described in connection with a preferred embodiment thereof, it will be appreciated by those skilled in the art that additions, modifications, substitutions, and deletions not specifically described may be made without departing from the spirit and scope of the invention as defined in the appended claims.

What is claimed is:

1. A board game comprising a board containing a plurality of playing areas which form diagonal rows, and a plurality of sets of square pieces positioned on the playing areas and movable thereon, each piece comprising a square having a triangular pointer on a top surface thereof which, when oriented in the direction of one of said rows toward a piece of the other set, places the latter under attack, each piece being originally placed on its associated playing area to orient said pointer out of the direction of said rows so as to be unable to place a piece of the other set under attack, each playing area having a smaller attack area therein oriented at 45 degrees relative to said playing area and corresponding in shape to said pieces.

2. A board game according to claim 1 wherein said playing areas are aligned in diagonal rows and are separated by separating areas.

3. A board game according to claim 1 wherein said sets of pieces are initially set up to form mutually facing pyramids, with the front piece of one pyramid laterally offset relative to the front piece of the other pyramid.

4. A board game comprising a board having playing areas and a plurality of sets of pieces positionable on said playing areas, each playing area having a smaller attack area therein oriented at an angle relative to said playing area and corresponding in shape to said pieces such that a piece can be turned within a given playing area to become aligned with said attack area, said playing areas shaped as squares and said attack areas shaped as smaller squares oriented at 45 degrees relative to said playing squares.

5. A board game according to claim 4 wherein said playing areas are aligned in diagonal rows and are separated by separating areas.

6. A board game according to claim 4 wherein said pieces each include indicator means directed along a diagonal row of playing areas when the piece is aligned with the attack area.

7. A board game according to claim 6 wherein said pieces each comprise a block and said indicator means comprises a triangle positioned on a top surface of said block.

8. A board game according to claim 6 wherein said sets of pieces are initially set up to form mutually facing pyramids, wherein the front piece of one pyramid is laterally offset relative to the front pyramid of the other set.

9. A board game comprising:

a board containing a plurality of alternate playing squares and separating squares, said playing squares aligned in diagonal rows, each playing square including a square attack area therein of smaller area and oriented at a 45 degree angle relative to said playing square, and a pair of sets of pieces movable on said playing squares, each piece corresponding in shape to that of said attack area and including pointer means, such that with a piece turned 45 degrees within said playing square, it becomes aligned with said attack area and points in the direction of one of said rows of playing squares.

10. A board game according to claim 9 wherein said sets of pieces are initially arranged on said playing squares to form mutually facing pyramids, with the front piece of one pyramid being laterally offset relative to the other pyramid.

11. A board game comprising a board having playing areas and a plurality of sets of pieces positionable on said playing areas, each playing area having a smaller attack area therein oriented at an angle relative to said playing area and corresponding in shape to said pieces such that a piece can be turned within a given playing area to become aligned with said attack area, said pieces each comprising a block and include indicator means in the form of a triangle positioned on a top surface of said block, said triangle directed along a diagonal row of playing areas when the piece is aligned with the attack area.

* * * * *